United States Patent [19]

Aeschlimann

[11] 3,970,245

[45] July 20, 1976

[54] UNIVERSAL CENTRIFUGE

[75] Inventor: Hans-Peter Aeschlimann, Kurpfalzring, Switzerland

[73] Assignee: Dr. Molter GmbH, Heidelberg, Germany

[22] Filed: May 21, 1975

[21] Appl. No.: 579,349

[52] U.S. Cl. ..... 233/24; 233/1 B; 210/138;143;145;146

[51] Int. Cl.² ..... B04B 9/10; B04B 7/04

[58] Field of Search ..... 233/23 R, 24, 26, 1 B, 233/1 R, 210/138, 143, 145, 146

[56] References Cited

UNITED STATES PATENTS 2,551,838 5/1951 Huser et al. ..... 210/145 X 2,752,044 6/1956 Olcott ..... 210/145 X

*Primary Examiner*—George H. Krizmanich

[57] ABSTRACT

A universal centrifuge adapted to be operated at pre-selected speeds for pre-selected time periods over a wide range of speeds to perform many different functions normally performed by different centrifuges. A safety system is included which prevents operation at high speeds unless a rotation head designed for high speed operation is mounted on the unit.

6 Claims, 6 Drawing Figures

UNIVERSAL CENTRIFUGE

This invention relates to centrifuges. More particularly, this invention relates to centrifuges which may be operated at pre-selected rotative speeds for pre-selected periods of time. This invention also relates to centrifuges capable of employing rotation heads designed for operation at different rotative speeds ranging from low to high speeds.

There are a number of tasks in the laboratory which are primarily performed with the help of a centrifuge, whether they be in serology, hematology, biochemistry or a different discipline. Quite often in this work, tests must be precisely duplicated or reliably reproduced. In these determinations both speed and time of rotation are important parameters.

Heretofore, it has been necessary to employ different centrifuge designs and types to attain different objectives in the different disciplines. For instance, rotation heads are differently designed to be operated in different speed ranges as well as to perform different functions and units designed for low speed operation normally are not capable of performing satisfactorily or operating safely at high speeds.

While prior art centrifuges have employed timing devices and means for preventing operation above the designed speed limit, no one unit has been suggested which is capable of operating at high or low centrifuging speeds and which can be used to perform all or most of the many functions of the centrifuge.

The centrifuge of this invention is universal in operation and performance characteristics. It is adapted to operate at rotative speeds ranging from low speeds of about 1,000 r.p.m. (revolutions per minute) to high speeds of about 15,000 r.p.m. or higher, in pre-selected time cycles during which the rotation head turns at a pre-selected constant rotative speed without acceleration or deceleration thereby assuring accuracy and reproducibility of results. This centrifuge comprises means for determining in advance or pre-selecting both the rotative speed of the head and its cycling time, and includes means for assuring that the cycling time is measured only at the pre-selected rotative speed. This includes means for sensing the rotative speed of the head and timing means activated by the sensing means for timing the rotation cycle of the head after it reaches the pre-selected rotative speed.

Another advantage of the centrifuge of this invention is that it is adapted to be operated in various speed ranges with different types of rotation heads which individually may be designed to operate only within a particular speed range. In its preferred form the centrifuge of this invention comprises a safety device which is rendered operable when the unit is adjusted for high speed rotation, i.e., when a high speed range is pre-selected, so that the device prevents operation of the centrifuge until a rotation head designed for operation within the pre-selected high speed range is mounted on the unit. Preferably, the safety device is adapted to be activated by means on the high speed rotation head to allow high speed operation when the head is in position on the unit. This may involve a magnetically activatable switch adapted to cooperate with magnetic means such as a simple magnet on the head for cooperating therewith to allow high speed operation. Other means, such as a switch adapted to be mechanically activated by contact with the high speed head, itself, when the head is mounted on the unit, also may be used in connection with the safety device of this invention.

These features of the present invention and others will become more apparent from the following description in which preferred and other embodiments of the invention have been set forth in detail in conjunction with the accompanying drawings wherein.

Figure 1:
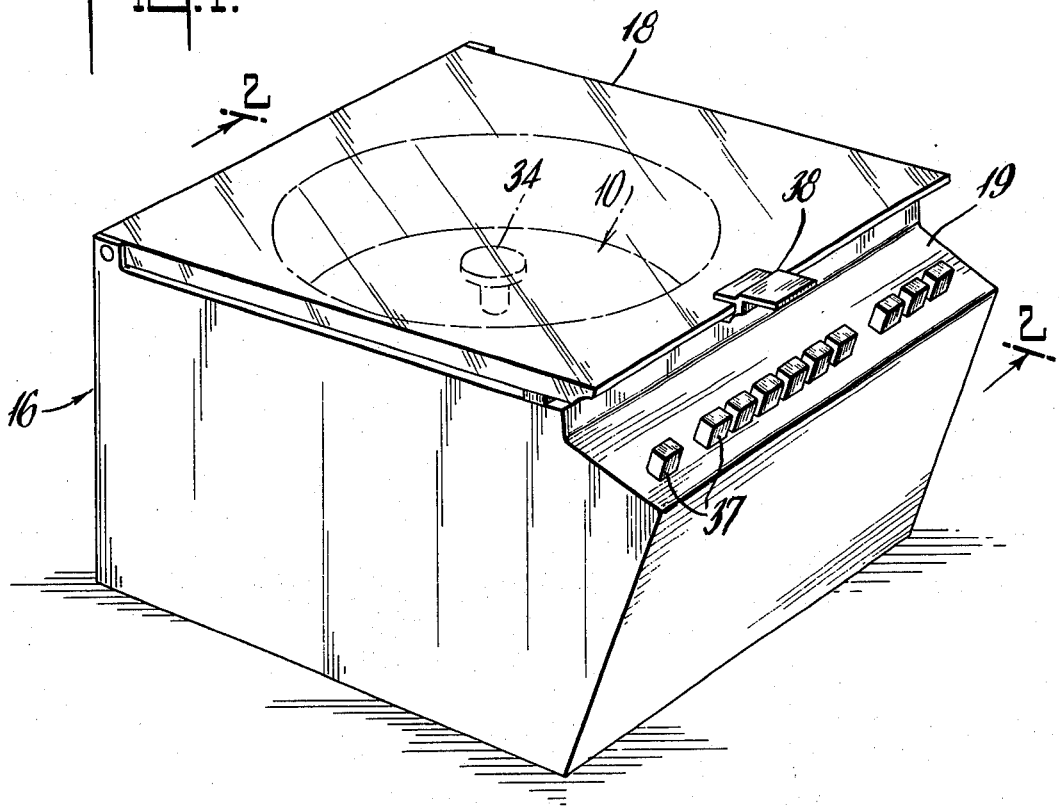
FIG. 1 is a view in perspective of a preferred embodiment of a centrifuge according to this invention.

Referring particularly to FIGS. 1 – 5 of the drawings, there is shown a centrifuge unit of this invention which comprises a rotation head 10 mounted on a vertical drive shaft 11 extending upwardly from an electrical drive unit 12 which, in turn, is mounted on a foundation 14 resting on the base plate 15 of the centrifuge housing 16. The housing is supported on feet 17 attached adjacent each of the corners of the base 15 and has a hinged protective cover 18 which must be closed to allow the unit to operate.

An inclined control panel 19 is integral with the front of the housing and a control console 21 depends from the panel 19 inside the housing. The controls of the console are connected to the drive unit 12 and to a magnetically operated safety switch 22 at the top of the drive unit through a harness or cable 23.

Figure 2:
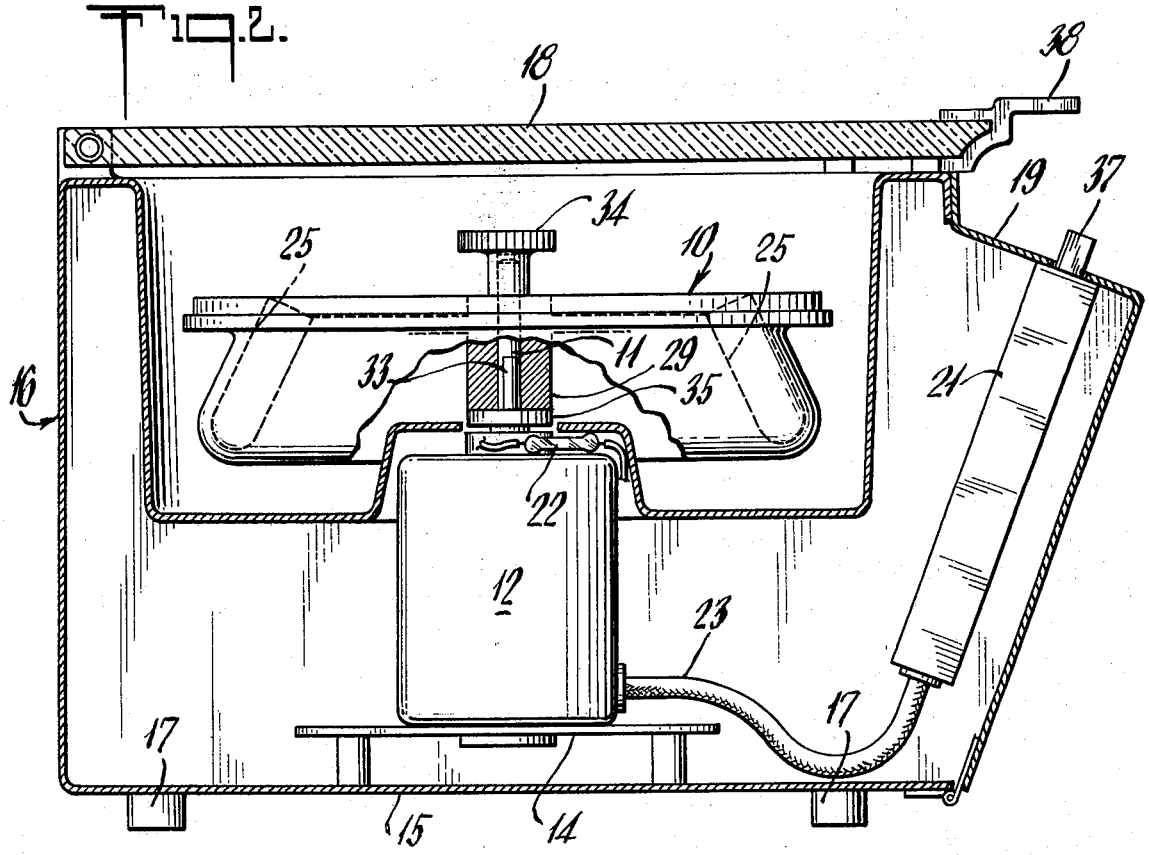
FIG. 2 is a somewhat enlarged side view partly in section and partly in elevation taken along the line 2—2 of FIG. 1.
Figure 3:
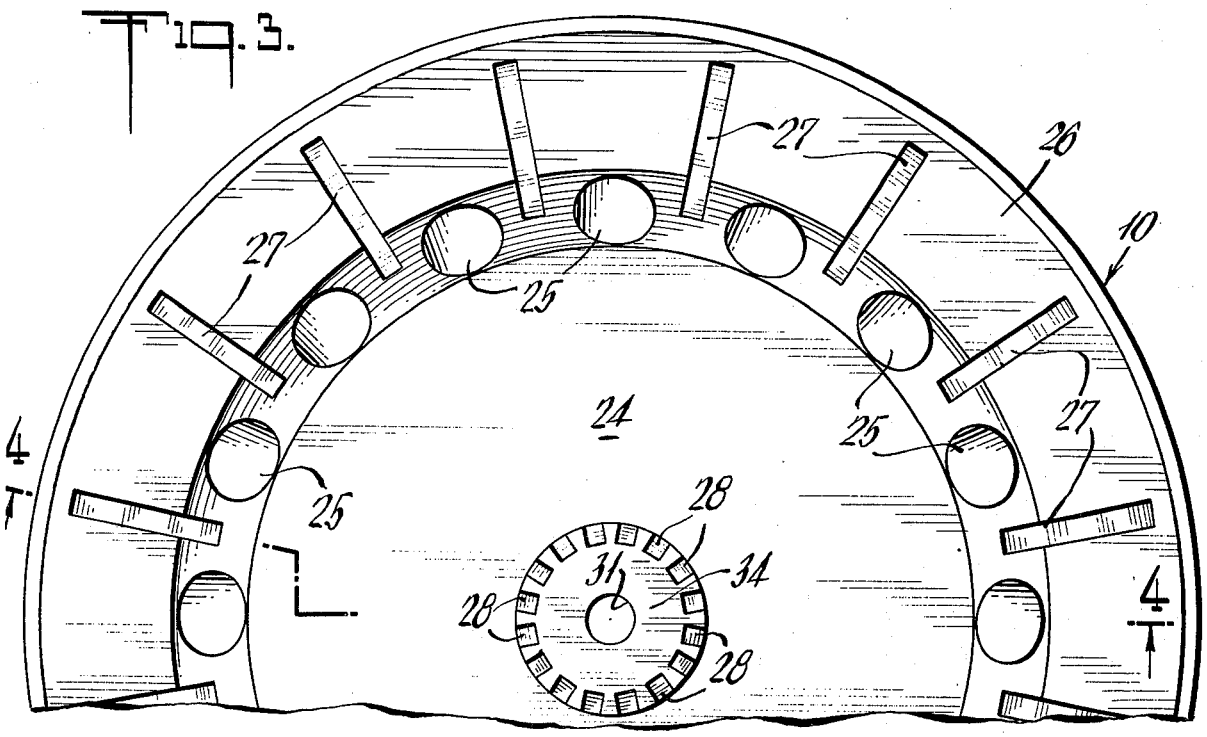
FIG. 3 is a further enlarged partial top plan view of the rotation head of the centrifuge of FIGS. 1 and 2.
Figure 4:
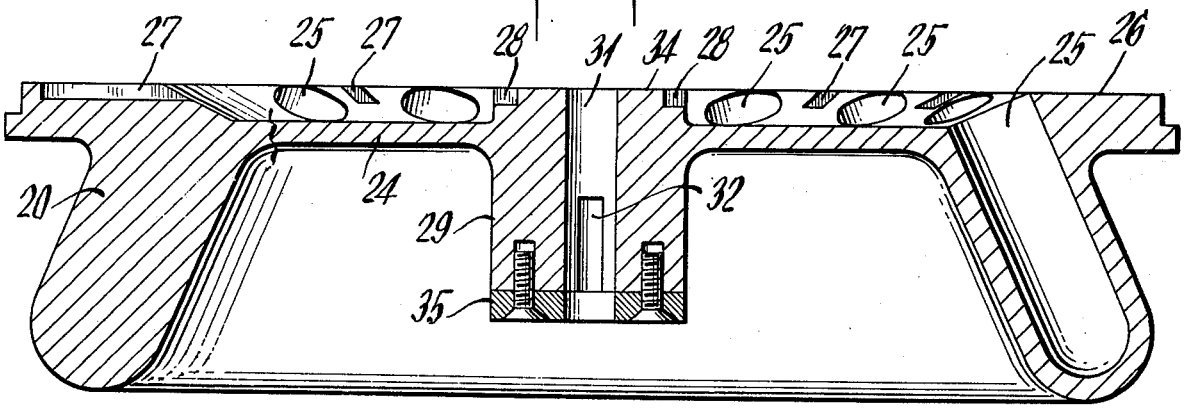
FIG. 4 is a similarly enlarged view partly in section and partly in elevation taken along the line 4—4 of FIG. 3.
Figure 5:
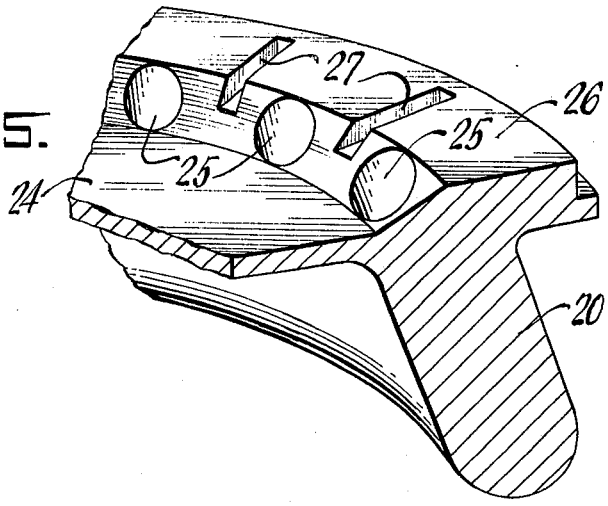
FIG. 5 is a view in perspective of a cut-away portion of the head of FIG. 4.

As shown most clearly in FIGS. 2 – 4, the rotation head 10 is in the form of a hollow frusto-conical cylinder 20 inclined upwardly and inwardly towards its axis and with a central disc or table portion 24 closing off the top of the cylinder. The cylinder itself contains a multiplicity, i.e., 16, inclined cavities 25 for holding test tubes, not shown, for performing various tests for which the unit may be employed. The cavities 25 are equally spaced about the axis of the head and like the cylinder itself, are inclined upwardly and inwardly towards its axis and are open at the top. The cylinder 20 includes an integral annular shelf 26 located radially outwardly and adjacent the open tops of the cavities 25. The top surface of the shelf 26 is at a level somewhat above that of the top surface of the table portion 24 of the head, and the shelf defines a series of radially extending horizontal slots 27 interrupting its top surface between the cavities 25. The slots 27 are adapted to cooperate with a corresponding series of radially extending slots 28, arranged in a star-shaped configuration in a central hub portion 29 integral with the table portion 24 of the head, for receiving capillary tubes, not shown, for volumetric tests and the like.

The hub 29 of the rotation head 10 defines a centrally located tube shaped opening 31 for receiving the drive shaft 11 for mounting the head on the shaft. The opening 31 defines a slot or keyway 32 for cooperating with a vertical key 33 secured to the drive shaft 11 for positively positioning the head rotatively with respect to the drive shaft. The head 10 then is held vertically on the drive shaft 11 by a retaining nut 34 removably screwed to the top of the shaft.

The rotation head 10 of this embodiment of the invention is constructed so as to be safely operable at low and high rotative speeds and is adapted for the variety of operations which can be performed at these speeds. For this purpose the head 10 carries a permanent magnet 35 fastened to the bottom of the hub 29, and the magnet 35 is adapted to cooperate with the magnetically operated safety switch 22 for permitting operation at high speeds in the manner which will be described more fully hereinafter.

Figure 6:
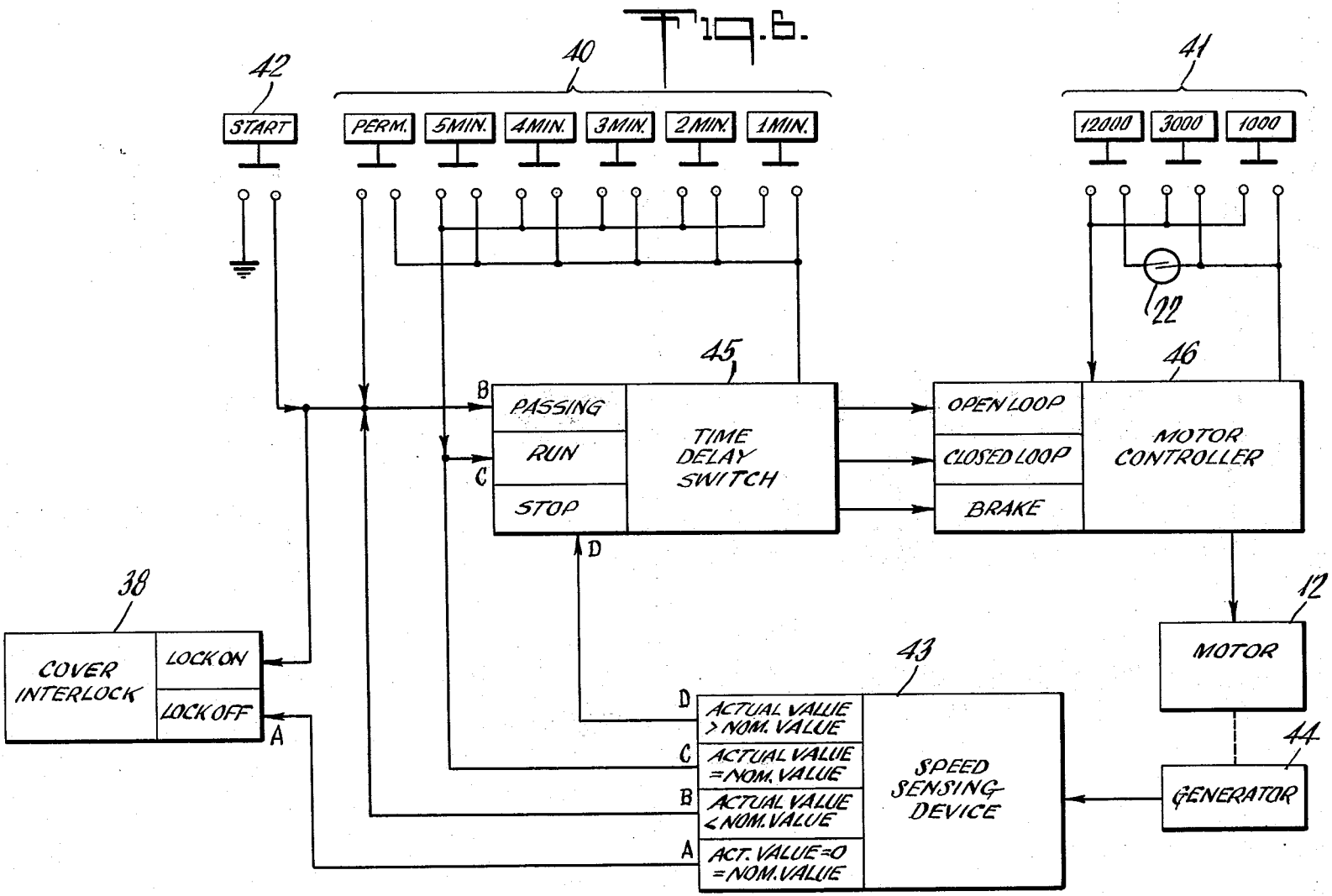
FIG. 6 is a schematic control diagram for the centrifuge of the preceding figures.

Referring particularly to FIGS. 1, 2 and 6 of the drawings, it will be seen that there are a series of 10 controls as indicated by the 10 pushbuttons 37 on the control panel 19 in FIG. 1 and the 10 pushbutton controls for starting, timing and speed control at the top of the control diagram of FIG. 6. To initiate operation of the centrifuge the operator conveniently pre-selects a time duration during which the rotation head will operate at constant speed by depressing one of six timing buttons 40 at the top left of FIG. 6, and also pre-selects a rotation speed by depressing one of three speed control buttons 41 at the top right of FIG. 6. Then the operator starts the centrifuge by depressing the "START" pushbutton 42, closing the circuit to the electrical drive unit 12 which turns the drive shaft 11 and rotation head 10 as seen in FIG. 2. The electrical drive unit of this embodiment of the invention is a high torque, variable speed electrical motor. A cover interlock 38 is provided on the cover 18 of the centrifuge. This interlock interrupts the connection between the START button 42 and the electrical motor 12, and is designed so that the centrifuge cover 18 must be closed in order to start the motor turning as will be explained more fully hereinafter.

After starting, the electrical motor 12 begins accelerating the drive shaft of the centrifuge and a speed sensing device 43 electrically monitors the speed of the drive shaft 11 and rotation head 10. The speed sensing device 43 constantly compares the instantaneous actual speed of the rotation head 10 with the nominal value pre-selected by depressing one of the buttons 41. The speed sensing device is a conventional electrical reference device which is responsive to the current generated by a generator 44 driven by the shaft 11. If the actual speed of operation is less than that pre-selected, the circuit remains in passing mode, shown by line B—B between the speed sensing device 43 and a time delay switch 45, and the motor continues to accelerate, as indicated by the arrow extending to the open loop of a motor controller 46 which, in turn controls the motor 12. When the constantly monitoring speed sensing device 43 senses that the actual instantaneous velocity of the rotation head is equal to the pre-selected speed, an impulse from the speed sensing device 43 immediately shifts the circuit to the run mode shown by line connection C—C extending between the sensing device and the time delay switch 45.

The time delay switch 45 is an electronic circuit functionally designed to delay the acceleration of the electrical motor 12 for a given time interval. Upon receiving a signal from the speed sensing device 43 that the pre-selected speed has been reached, the time delay switch 45 is activated and sends a signal to the electrical motor 12 as indicated by the arrow extending to the closed loop of the motor controller 46. The motor then stops accelerating but continues to operate (at a constant velocity) at the pre-selected speed for the time period which has been pre-selected by depressing one of the buttons 40 which actuates the appropriate timing circuitry of the time delay switch 45.

When the pre-selected time period expires, the delaying function of the time delay switch 45 ceases, and the electrical driving motor 12 starts to accelerate again. However, as soon as the actual instantaneous speed of the rotation head 10 exceeds the nominal pre-selected speed, the speed sensing device 43 sends an impulse to the time delay switch 45 to open the circuit thereby causing deceleration of the motor 12 and bringing it to a stop. This inter-relationship is shown by line connection D—D between the speed sensing device 43 and the time delay switch 45 and the arrow extending from the time delay switch and the brake of the motor controller 46.

As explained hereinbefore, the cover interlock 38 prevents operation of the centrifuge when the cover is not closed. This also works in reverse in that the cover cannot be opened while the rotation head 10 is turning. For this purpose, as shown in FIG. 6, the interlock 38 receives signals from the speed sensing device 43 so that the cover will remain locked if the speed of the rotation head is greater than zero. This connection is shown be the line A—A.

The magnetically activatable switch 22 is shown in FIG. 6 connected between the "12,000" r.p.m. speed control pushbutton and the motor controller 46 in such a way that the centrifuge cannot be operated at 12,000 r.p.m. unless the switch 22 is closed. The switch 22 is normally open but is adapted to be closed by the magnet 35 on the hub of the rotation head 10. Thus, the rotation head 10 of this embodiment of the invention is adapted to be operated at high speeds, i.e., 12,000 r.p.m. as well as the medium and low speeds, i.e., 3,000 and 1,000 r.p.m., for which this circuitry is designed. Obviously, since the magnetically operable switch 22 is not connected between the motor controller and either of the 3,000 or 1,000 r.p.m. pushbuttons, other rotation heads without magnetic devices for operating the switch 22 may be employed on the centrifuge of this embodiment of the invention when it is operated at these medium and low speeds.

Having now described the invention in specific detail and exemplified the manner in which it may be carried into practice, it will be readily apparent to those skilled in the art that innumerable variations, applications, modifications, and extensions of the basic principles involved may be made without departing from its spirit or scope. For example, while it has been indicated that the centrifuge of this invention may be adapted to operate over a wide range of speeds from low speeds of about 1,000 r.p.m. to high speeds of about 15,000 r.p.m. or higher and the drawings illustrate a preferred embodiment adapted to operate at speeds ranging from 1,000 to 12,000 r.p.m., one skilled in the art will realize that the principles of this invention will apply to almost any speed range or combinations of speeds wherein the close control achievable by this invention is necessary or desirable. In this connection, the safety feature of this invention, wherein the centrifuge cannot be operated at the higher speeds requiring a specially designed rotation head unless the appropriate head activates a safety switch, may be adapted to other specific needs of the centrifuge. It is possible, for instance, to have more than one safety switch where ultra-high speed operation is required and the rotation head must be specially designed to perform a novel function at such a speed. One skilled in the art will realize that the simple magnet and magnetically operated safety switch described in the drawings may be replaced by other conventional means associated with the rotation head and the driving means, respectively, for assuring that the proper head is being used for the speed or function which has been pre-selected. Similarly, any conventional speed sensing device capable of comparing the actual and pre-selected speeds of the rotation head may be employed to operate the time delay switch and motor controller of this invention. Many other variations within the scope of this invention also will be apparent to one skilled in the art.

What is claimed is:

1. A centrifuge comprising a drive shaft, a rotation head detachably mounted on said shaft, drive means for rotating said shaft and said head mounted thereon at rotative speeds ranging from low speeds to high speeds, and control means for regulating the rotative speed of said drive means, said control means comprising means for pre-selecting both the rotative speed and the cycling time of said head, means for sensing the rotative speed of said head and timing means activated by said sensing means for timing the rotation cycle of said head when said head reaches the pre-selected rotative speed.

2. A centrifuge according to claim 1, wherein said drive means is a variable speed electrical motor and said timing means is a time delay switch, said speed sensing means being adapted to activate said time delay switch when the rotation head has reached the pre-selected speed, and said time delay switch being adapted to control the speed of said motor to cause the motor to operate at said pre-selected speed for the pre-selected period of time and decelerate at the termination of said time period.

3. A centrifuge according to claim 1, which is adapted to operate within a rotative speed range of about 1,000 – 15,000 revolutions per minute.

4. A centrifuge according to claim 1, which further comprises a safety means adapted to prevent operation of said drive means only when a predetermined high speed range is pre-selected, said safety means being activatable to allow operation of said drive means when a rotation head designed for operation within said predetermined high speed range is mounted on said shaft.

5. A centrifuge according to claim 4, wherein said rotation head includes means for cooperating with the safety device for activating said means.

6. A centrifuge according to claim 5, wherein the safety means comprises a magnetically activatable switch and said cooperating means includes magnetic means capable of operating said switch.

* * * * *

UNITED STATES PATENT AND TRADEMARK OFFICE

CERTIFICATE OF CORRECTION

PATENT NO. : 3,970,245

DATED : July 20, 1976

INVENTOR(S) : Hans-Peter Aeschlimann

It is certified that error appears in the above–identified patent and that said Letters Patent are hereby corrected as shown below:

TITLE: Reads UNIVERSAL CENTRIFUGE, should read --- SPEED CONTROLLED UNIVERSAL CENTRIFUGE---

In Column 4, Line 26, "shown be the line A-A" should read---shown by the lines A-A---

Signed and Sealed this

Fourth Day of January 1977

[SEAL]

*Attest:*

RUTH C. MASON
*Attesting Officer*

C. MARSHALL DANN
*Commissioner of Patents and Trademarks*